US005250103A

United States Patent [19]

Yamauchi et al.

[11] Patent Number: 5,250,103

[45] Date of Patent: Oct. 5, 1993

[54] AUTOMATIC MOLTEN METAL SUPPLYING DEVICE AND METHOD FOR SUPPLYING THE MOLTEN METAL

[75] Inventors: Noriyoshi Yamauchi; Hitoshi Ishida, both of Fuchu, Japan

[73] Assignee: Ryobi Ltd., Hiroshima, Japan

[21] Appl. No.: 842,926

[22] Filed: Feb. 27, 1992

[30] Foreign Application Priority Data

Mar. 4, 1991 [JP] Japan ..... 3-062715

[51] Int. Cl.[5] ..... B22D 39/02

[52] U.S. Cl. ..... 75/584; 266/237

[58] Field of Search ..... 266/237, 236; 75/584; 222/590, 591

[56] References Cited

FOREIGN PATENT DOCUMENTS 245721 4/1912 Fed. Rep. of Germany .
55-55256 10/1988 Japan .
2-42751 3/1990 Japan .
432734 9/1967 Switzerland .
914449 7/1961 United Kingdom .

*Primary Examiner*—Scott Kastler
*Attorney, Agent, or Firm*—Sughrue, Mion, Zinn, Macpeak & Seas

[57] ABSTRACT

An automatic molten metal supplying device and supplying method capable of promoting discharge of molten metal retained in a ladle during pouring into an injection sleeve of a die-casting machine, and capable of preventing a residual molten metal from being suspended from the intake/discharge port. A ladle is selectively communicatable with an atmosphere by the opening/closing unit. The opening/closing unit is connected to a molten metal pressurizing mechanism 20 and a residual molten metal removing mechanism 30 through pipes. At the time of pouring, small volume or low pressure fluid is introduced into the ladle by means of the molten metal pressurizing mechanism through the opening/closing unit. After completion of the pouring, large volume or high pressure fluid is introduced into the ladle by the residual molten metal removing mechanism. Since low volume or low pressure fluid is applied into the ladle during pouring, the molten metal can be smoothly discharged from the ladle. After the pouring, since large volume or high pressure fluid is applied into the ladle, residual molten metal in the ladle can be discharged therefrom, and no molten metal suspension from the intake-discharge port occurs. Thus, casting period can be reduced, and clean working condition can be provided.

14 Claims, 2 Drawing Sheets

AUTOMATIC MOLTEN METAL SUPPLYING DEVICE AND METHOD FOR SUPPLYING THE MOLTEN METAL

BACKGROUND OF THE INVENTION

The present invention relates to a device and method for automatically supplying molten metal, and more particularly, to the automatic supplying device and the supplying method for successively supplying a molten metal to a metal mold having a small volume.

For automatically supplying a molten metal having a small volume such as from 5 grams to several hundreds grams to a casting port of a die-casting machine, it would be generally difficult to maintain accuracy of molten metal supplying amount and to prevent temperature of the supplied molten metal from being lowered.

In order to overcome this problem, several proposals have been made. For example, Japanese Utility Model Application Kokai No. 55-55256 discloses a ladle for transferring a molten metal. An upper open end of the ladle is covered with a lid formed with a hole, and a center portion of a bottom of the ladle is formed with a molten metal intake/discharge port. A tube is provided having one end connected to the hole, and another end connected to an opening/closing valve so as to selectively communicate an internal space of the ladle with an atmosphere. If the opening/closing valve is opened, the molten metal can be flowed into the ladle, and if the opening/closing valve is closed, the molten metal in the ladle can be transferred. If the valve is again opened, the molten metal in the ladle is discharged into a casting port of a die-casting machine. Further, a vacuum suction means is connected to the opening/closing valve for providing negative pressure within the ladle so as to enhance suction efficiency of the molten metal thereinto and to prevent the molten metal from being dripped from the ladle during its transfer.

According to the above described conventional molten metal supplying device, since pouring is performed by introducing the atmospheric pressure into the ladle through the opening/closing valve and by making use of own weight of the molten metal, relatively prolonged time may be required for pouring. Therefore, a shot cycle is prolonged to lower productivity. Since the shot cycle is prolonged, temperature of the molten metal within the ladle is promptly decreased if a small amount of the molten metal is carried in the ladle. Accordingly, quality of die-casting product may be degraded. Further, since the pouring is performed by the weight of the molten metal, a finally discharged molten metal may be suspended from the intake/discharge port in the form of an icicle. If the suspended molten metal is solidified, subsequent operation may not be achievable. Furthermore, if the icicle formed residual molten metal is dropped down during returning stroke of the ladle toward the molten metal intaking position, the dropped and accumulated molten metal at the moving path of the ladle may prevent the ladle from being transferred.

SUMMARY OF THE INVENTION

Thus, it is an object of the present invention to provide an automatic molten metal supplying device and method in which a shot cycle can be reduced, and no substantial temperature decrease occurs in the molten metal during its transfer, accuracy in molten metal supplying amount is not lowered, and no residual molten metal suspension from the ladle occurs.

In order to achieve the above described objects, the present invention provides an automatic molten metal supplying device for automatically supplying a molten metal in a holding furnace to an intended casting port comprising (a) a ladle providing a molten metal accumulation space and having a lower portion formed with a molten metal intake/discharge port through which the molten metal is introduced into the accumulation space and the molten metal is poured into the casting port, the ladle having an upper portion, (b) opening/-closing means connected to the upper portion of the ladle for selectively communicating the accumulation space with an atmosphere, (c) molten metal pressurizing mechanism connected to the opening/closing means for supplying pressurized fluid having a first pressure level higher than an atmospheric pressure into the accumulation space through the opening/closing means during pouring, and (d) residual molten metal removing mechanism connected to the opening/closing means for supplying pressurized fluid having a second pressure level higher than the first pressure level into the accumulation space through the opening/closing means after completion of the pouring.

In another aspect, according to the present invention, there is provided a method for automatically supplying a molten metal to an intended casting port, the method including the steps of introducing the molten metal into a ladle at a holding furnace by communicating an interior of the ladle with an atmosphere, transferring the ladle which retains the molten metal therein to a casting port while disconnecting the interior from the atmosphere, the improvement comprising the steps of (a) communicating the interior of the ladle with the atmosphere for discharging the molten metal into the casting port by making use of atmospheric pressure and own weight of the molten metal, (b) supplying from a compressed fluid source a pressurized fluid having a first pressure level higher than an atmospheric pressure, toward the molten metal retained in the ladle for promoting the discharge of the molten metal from the ladle, and (c) supplying from the compressed fluid source the pressurized fluid having a second pressure level higher than the first pressure level, into the ladle for removing a residual molten metal which may be retained in or suspended from the ladle.

By the opening operation of the opening/closing means, the interior of the ladle is communicated with the atmosphere through the opening/closing means, so that the molten metal in the ladle is discharged through the intake/discharge port into a predetermined position for performing pouring operation. In this case, molten metal pressurizing mechanism is operated for supplying small volume or low pressure fluid onto a surface of the molten metal retained in the ladle through the opening/closing means. Therefore, discharge of the molten metal can be promoted. Further, upon completion of the pouring, small amount of the molten metal may still be retained in the ladle or may be suspended from the intake/discharge port. However, since the residual molten metal removing mechanism is operated for introducing large volume or highly pressurized fluid into the ladle through the opening/closing means, such residual molten metal can also be discharged.

DETAILED DESCRIPTION OF THE PREFERRED EMBODIMENTS

Figure 1:
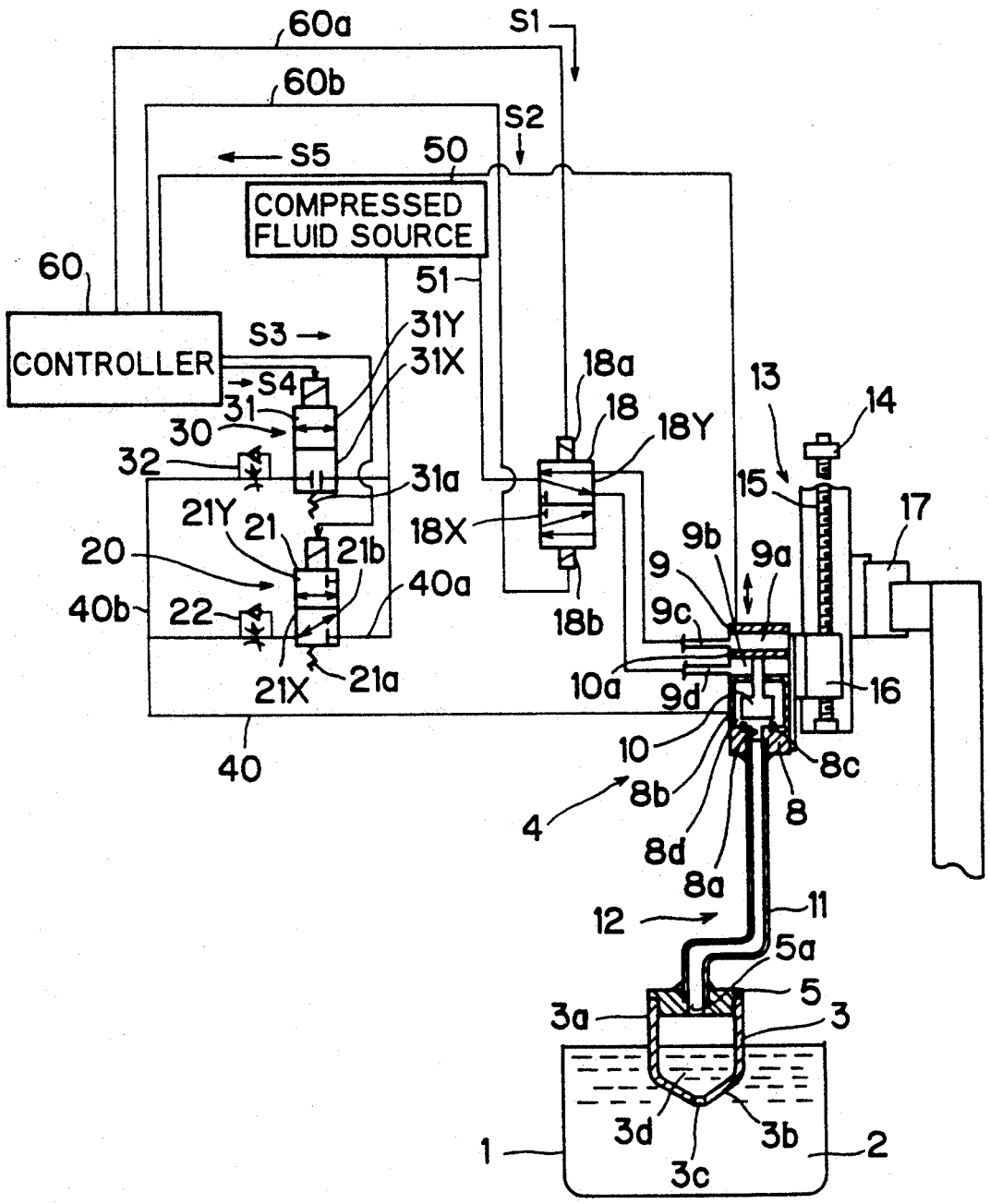
FIG. 1 is a schematic view showing an automatic molten metal supplying device according to a first embodiment of the present invention.

An automatic molten metal supplying device according to a first embodiment of the present invention will be described with reference to FIG. 1. A ladle 3 used in the depicted embodiment is adapted to be movably dipped in a molten metal 2 accumulated in a holding furnace 1. The ladle 3 has an upper open end portion 3*a* and a tapered bottom portion 3*b* whose apex end is formed with a molten metal intake/discharge port 3*c*. A lid member 5 is engageable with the upper open end 3*a* for closing the open end area, to thereby provide a molten metal accumulating space 3*d*. A through hole 5*a* is bored in the lid member 5. The through hole 5*a* is connected to an opening/closing means 4 through a tubular member 11.

The opening/closing means 4 has a valve body 8, a pneumatic cylinder 9, an opening/closing valve 10 driven by the pneumatic cylinder 9, and a valve driving means 18 for operating the valve 10. The opening/closing valve 10 is connected to a piston 10*a* slidably reciprocatable within the pneumatic cylinder 9. The piston 10*a* divides the pneumatic cylinder 9 into first and second cylinder chambers 9*a* and 9*b* to which one ends of first and second fluid passages 9*c* and 9*d* are connected respectively. Another ends of the fluid passages 9*c* and 9*d* are connected to a compressed fluid source 50 through the valve driving means 18, the compressed fluid being air or inert gas.

Within the valve body 8, a valve chamber 8*d* is provided in which the opening/closing valve 10 is movably disposed. The valve body 8 is provided with a seal member 8*c* and is formed with a bore 8*a* at a position in abutment with the opening/closing valve 10. Further, a through hole 8*b* is formed at a side wall of the valve body 8 for communicating the valve chamber 8*d* with an atmosphere through a first change-over valve 21 described later. The bore 8*a* is connected to the through hole 5*a* of the lid member 5 by means of the tubular member 11.

The valve driving means 18 is constituted by an electromagnetic valve 18 having first and second solenoids 18*a*, 18*b*. The electromagnetic valve 18 is connected to the compressed fluid source 50 via a fluid passage 51. The first and second solenoids 18*a*, 18*b* are connected to a controller 60 of a die-casting machine through lines 60*a*, 60*b*, respectively so as to provide a first position 18X and a second position 18Y (FIG. 1) of the electromagnetic valve 18. That is, through the lines 60*a*, 60*b*, valve opening signal S1 and valve closing signal S2 are transmitted from the controller 60 to the first and second solenoids 18*a*, 18*b*, respectively. The other ends of the first and second fluid passages 9*c*, 9*d* are connected to the electromagnetic valve 18. Thus, the piston 10*a* is movable downwardly or upwardly by applying fluid pressure into the first and second cylinder chambers 9*a* , 9*b*, in order to close and open the opening/closing valve 10.

The above described through hole 8*b* of the valve chamber 8*d* is connected to a molten metal pressurizing mechanism 20 and a residual molten metal removing mechanism 30. First, the molten metal pressurizing mechanism 20 will be described.

The molten metal pressurizing mechanism 20 is adapted for applying small volume or low pressure of pressurized fluid onto a surface of the molten metal in the ladle 3 through a fluid passageway including the through hole 8*b*, the valve chamber 8*d*, the bore 8*a* and the tubular member 11 during opening phase of the opening/closing valve 10 at the time of pouring in order to provide smooth discharge of the molten metal from the ladle 3. To this effect, the molten metal pressurizing mechanism 20 includes the first change-over valve 21 and a first flow rate control valve 22 provided with a check valve. The through hole 8*b* is connected to a pipe 40 which is branched into a first branch pipe 40*a* and a second branch pipe 40*b*. The first flow rate control valve 22 having the check valve is connected to the first branch pipe 40*a*, and at a position upstream of the flow rate control valve 22, the first change-over valve 21 is connected to the first branch pipe 40*a*.

The first change-over valve 21 is further connected to a compressed fluid source 50. Further, the first change-over valve 21 is electrically connected to the controller 60 of the die-casting machine which transmits operation command signal S3 to the change-over valve 21. In a state shown in FIG. 1, no operation command signal S3 is transmitted to the first change-over valve 21, so that the latter has a first change-over position 21X by a biasing force of a spring 21*a*. Thus, the compressed fluid source 50 is disconnected from the through hole 8*b*. Incidentally, in this state, the through hole 8*b* is communicated with an atmosphere through the pipe 40, and an open port 21*b* of the first change-over valve 21. The first flow rate control valve 22 having the check valve is adapted for restricting inherently large volume of compressed fluid from the compressed fluid source 50 into a small volume of compressed fluid, and for applying the restricted fluid into the surface of the molten metal in the ladle 3 through the pipe 40, when the first operation command signal S3 is outputted to the first change-over valve 21 for moving the valve 21 into a second change-over position 21Y to permit the compressed fluid from the compressed fluid source 50 to be flowed into the pipe 40.

The residual molten metal removing mechanism 30 is adapted for applying large volume of pressurized fluid into an internal portion of the ladle 3, through the above described fluid passageway, in order to blow away a residual molten metal in the ladle 3 or a residual molten metal suspended from the intake/discharge port 3*c* in the form of icicle, to thereby remove the residual molten metal from the ladle. To this effect, the residual molten metal removing mechanism 30 includes a second change-over valve 31 and a second flow rate control valve 32 having a check valve. The second flow rate control valve 32 having the check valve is connected to the second branch pipe 40*b*, and the second change-over valve 31 is positioned at upstream side of the second flow rate control valve 32.

The second change-over valve 31 is connected to the compressed fluid source 50. The second change-over valve 31 is electrically connected to the controller 60 of the diecasting machine so that a second operation command signal S4 is transmitted from the controller 60 to the second change-over valve 31. In a state shown in FIG. 1, no operation command signal S4 is transmitted to the second change-over valve 31, so that the latter has a first change-over position 31X by a biasing force of a spring 31*a*. Thus, fluid communication between the compressed fluid source 50 and the through hole 8*b* is blocked. The second flow rate control valve 32 having the check valve is adapted for applying inherently large volume pressurized fluid from the compressed fluid source 50 into the internal portion of the ladle 3 through the pipe 40, when the second change-over valve 31 receives the second operation command signal S4 to move the valve 31 to a second change-over position 31Y in order to permit the fluid from the compressed fluid source 50 to be flowed into the pipe 40.

A timer (not shown) is accommodated in the controller 60 of the die-casting machine, so that first and second operation command signal transmitting period can be controlled. Thus, period for flowing the pressurized fluid into the ladle is controllable. The first and second flow rate control valves 22, 32 provided with check valves have regulation valves, respectively. Opening angles of these regulation valves can be controlled for controlling flow amounts. Further, the pneumatic cylinder 9 is connected to the controller 60 of the die-casting machine. When the opening operation of the opening/-closing valve 10 is terminated, operation completion signal S5 is outputted to the controller 60. Thus, the first operation command signal S3 is generated in response to the completion signal S5.

The ladle 3 and the opening/closing means 4 constitute molten metal supplying unit 12 which is supported to a vertical moving means 13. The vertical moving means 13 includes a drive motor 14, a ball screw 15 coupled to the drive motor 14, and a slider 16 threadingly engaged with the ball screw 15. The valve body 8 is attached to the slider 16. Upon rotation of the drive motor 14, the ball screw 15 is rotated about its axis for moving the slider 16 upwardly or downwardly. Accordingly, the molten metal supplying unit 12 is moved upwardly or downwardly. Thus, the dipping amount of the ladle 3 into the holding furnace 1 is controllable. The vertical moving means 13 is connected to a transfer means 17 for horizontally carrying the ladle 3 to bring the intake/discharge port 3*c* of the ladle 3 into alignment with a casting port (not shown) of an injection sleeve (not shown) of a metal mold (not shown) in the die-casting machine and to reversely move the ladle 3 toward the holding furnace 1.

Operation of the automatic molten metal supplying device will be described. For introducing into the ladle 3 the molten metal in the holding furnace 1, the opening/closing valve 10 is operated to be opened. That is, if the solenoid 18*a* receives the valve opening signal S1 from the controller 60 through the line 60*a* while the first and second change-over valves 21, 31 have first change-over positions 21X, 31X, the electromagnetic valve 18 is changed-over to the second change-over position 18Y (FIG. 1). Thus, compressed fluid in the compressed fluid source 50 is supplied to the second cylinder chamber 9*b* through the fluid passage 51, the electromagnetic valve 18, and the second fluid passage 9*d*. On the other hand, compressed fluid in the first cylinder chamber 9*a* is discharged to the atmosphere through the first fluid passage 9*c* and the electromagnetic valve 18. Consequently, the opening/closing valve 10 is upwardly moved away from the opening portion of the bore 8*a* , so that the atmospheric pressure is applied into the molten metal accumulating space 3*d* through the opening port 21*b* of the first change-over valve 21, the first flow rate control valve 22 having the check valve, the pipe 40, the through hole 8*b*, the tubular member 11 and the through hole 5*a*.

While maintaining this state, the drive motor 14 of the vertical moving means 13 is rotated by a predetermined angular amount so as to rotate the ball screw 15 about its axis, to thereby move the slider 16 to a predetermined position. Thus, the lower portion of the ladle 3 is dipped in the molten metal 2 by a predetermined depth. In this case, since the molten metal accumulating space 3*d* is communicated with the atmosphere, the molten metal 2 in the holding furnace 1 is introduced into the molten metal accumulation space 3*d* through the intake/discharge port 3*c* until the level of the molten metal in the space 3*d* is equal to the molten metal surface level in the holding furnace 1.

If the molten metal having the predetermined amount has been introduced into the ladle 3, the opening/closing valve 10 is to be closed. That is, the electromagnetic valve 18 is changed-over to the first change-over position 18X when the solenoid 18*b* receives the valve closing signal S2 from the controller 60. Accordingly, compressed fluid in the compressed fluid source 50 is supplied to the first cylinder chamber 9*a* through the fluid passage 51, the electromagnetic valve 18, and the first fluid passage 9*c*. On the other hand, compressed fluid in the second cylinder chamber 9*b* is discharged to the atmosphere through the second fluid passage 9*d* and the electromagnetic valve 18. Thus, the opening/closing valve 10 is moved downwardly, so that the valve 10 closes the opening end of the bore 8*a* through the sealing member 8*c*. Consequently, the molten metal accumulating space 3*d* is shut-off from the atmosphere.

Subsequently, the vertical moving means 13 is operated for elevating the molten metal supplying unit 12. In this case, since the molten metal accumulating space 3*d* is shut off from the atmosphere, the molten metal 2 in the ladle 3 is not discharged through the intake/discharge port 3*c*. Upon completion of the elevation of the molten metal supplying unit 12, the transfer unit 17 is operated for moving the molten metal supplying unit 12 to the casting port of the injection sleeve (not shown) in the die-casting machine. Then, the molten metal in the ladle 3 is poured into the injection sleeve. In this case, the pneumatic cylinder 9 is again operated to open the opening/closing valve 10 in order to introduce atmosphere through the communication hole 8*b* into the molten metal accumulating space 3*d* by way of the opening port 21*b* of the first change-over valve 21, the first flow rate control valve 22 having the check valve, the pipe 40, the through hole 8*b*, the tubular member 11 and the through-hole 5*a*. As a result, the molten metal in the ladle 3 begins to drop into the injection sleeve through the intake/discharge port 3*c* because of atmospheric pressure and own weight of the molten metal.

Upon completion of the valve opening operation of the opening/closing valve 10 by the pneumatic cylinder 9, operation completion signal S5 is transmitted to the controller 60 of the die-casting machine. In response to the signal S5, the controller 60 outputs first operation command signal S3 to the first change-over valve 21. In response to the command signal S3, the first change-over valve 21 which has been positioned at its first change-over position 21X (FIG. 1) is moved to the second change-over position 21Y. Therefore, a small volume of pressurized fluid from the compressed fluid source 50 is flowed through the first change-over valve 21. This pressurized fluid undergoes flow rate restriction when it passes through the first flow rate control valve 22 having the check valve, so that small volume of the pressurized fluid is introduced into the ladle 3 through the pipe 40, the through hole 8*b*, the valve chamber 8*d*, the bore 8*a*, the tubular member 11 and the through hole 5*a* (these constitute the fluid passageway). Accordingly, fluid pressure is applied to the molten metal in the molten metal accumulating space 3*d* for promoting the discharge of the molten metal. As a result, casting period can be reduced, and stabilized casting is achievable. Incidentally, the pressure application period is controllable by controlling the timer accommodated in the controller 60 in accordance with an intended casting period.

Next, simultaneously when the preset period preset in the timer is elapsed (if the casting is completed), the second operation command signal S4 is outputted from the controller 60 to the second change-over valve 31. In response to the command signal S4, the second change-over valve 31 which has been positioned at its first change-over position 31X (FIG. 1) is moved to the second change-over position 31Y. Accordingly, large volume of pressurized fluid from the compressed fluid source 50 is flowed through the second change-over valve 31. In this case, the first change-over valve 21 maintains its second change-over position 21Y. This compressed fluid undergoes flow rate restriction when it passes through the second flow rate control valve 32 having the check valve, so that predetermined (large) volume of pressurized fluid is introduced into the ladle 3 through the above described fluid passageway 40, 8*b*, 8*d*, 8*a*, 11 and 5*a*. Thus, residual molten metal in the ladle 3 or icicle formed residual molten metal suspended from the intake/discharge port 3*c* can be blown away by the pressurized fluid and can be removed therefrom. Upon elapse of predetermined period, the output of the second operation command signal S4 is terminated, so that the first and second change-over valves 21, 31 are returned to their first change-over positions 21X, 31X, to thereby complete the pouring process.

Upon completion of pouring into the injection sleeve, a transfer drive signal is outputted from the controller 60 of the die-casting machine for operating the transfer unit 17, so that the molten metal supplying unit 12 is again moved back to a position above the holding furnace 1. The above operation is repeatedly carried out for effectively and successively supplying the molten metal into the injection sleeve.

An automatic molten metal supplying device according to a second embodiment of the present invention will be described with reference to FIG. 2 wherein like parts and components are designated by the same reference characters as those shown in FIG. 1.

The automatic molten metal supplying device according to the second embodiment provides a structure the same as that of the first embodiment except opening/closing means 4A and a first change-over valve 21'. The opening/closing means 4A is not provided with the opening/closing valve 10 nor the piston 10*a* of the first embodiment, but provides the valve body 8 and the electromagnetic valve 19. An internal space of the valve body 8 is selectively communicatable with the atmosphere through a passage 19*d* and an opening port 19*b* of the electromagnetic valve 19. The electromagnetic valve 19 can have a first change-over position 19X where its internal space is shut off from the atmosphere, and a second change-over position 19Y (FIG. 2) where the internal space is communicated with the atmosphere. For this, the electromagnetic valve 19 is provided with a solenoid 19*a* which is connected to the controller 60 through a line 60*c*. Further, a spring 19*c* is also connected to the electromagnetic valve 19 for normally urging the latter to the second change-over position 19Y.

One of the pipes 40 is directly connected to the electromagnetic valve 19. The pipe 40 is communicatable with the valve body 8 through the electromagnetic valve 19 when the latter has the first change-over position 19X. Further, a portion 21*b'* which corresponds to the opening port 21*b* of the first embodiment is not communicated with the atmosphere, but is directly connected to the compressed fluid source 50.

Figure 2:
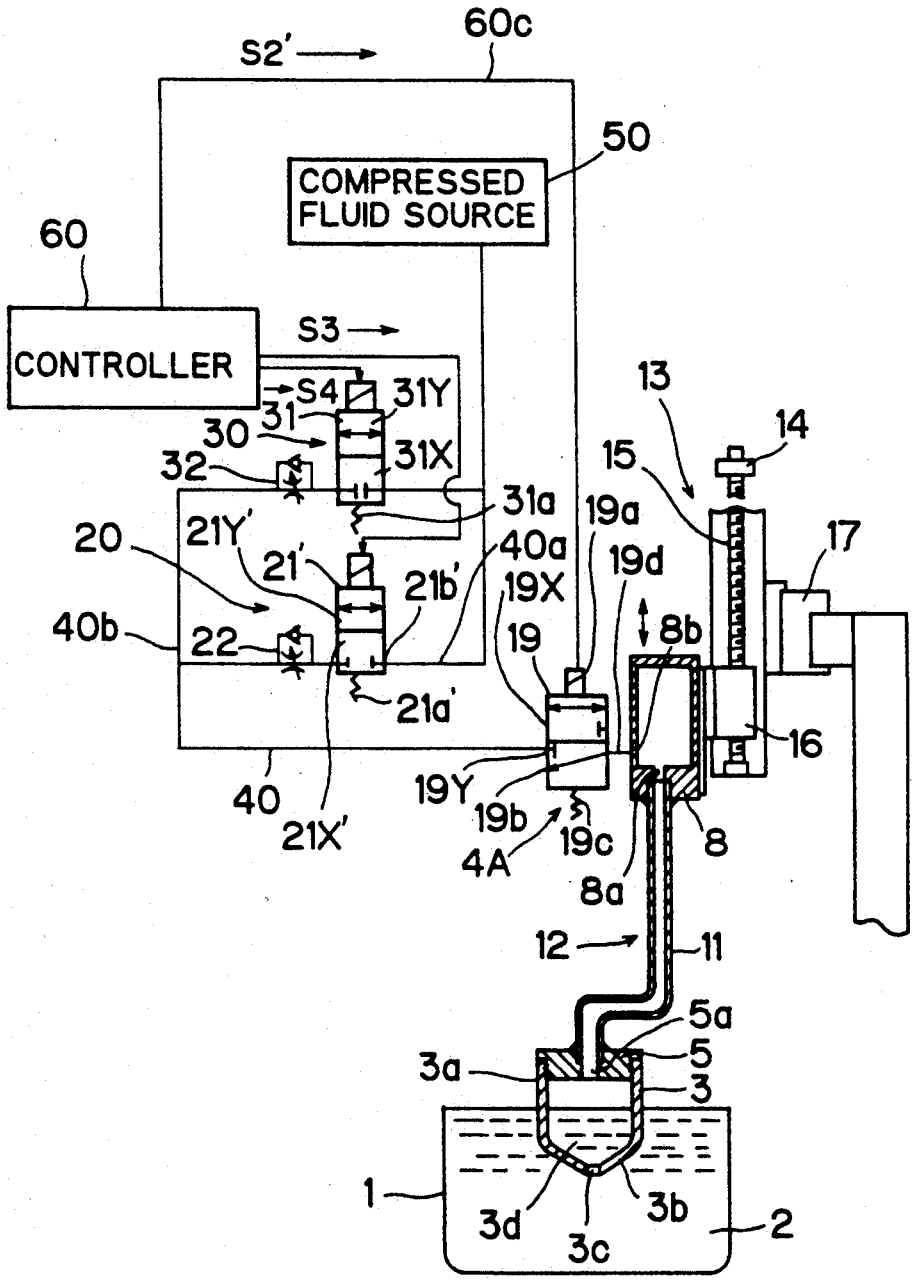
FIG. 2 is a schematic view showing an automatic molten metal supplying device according to a second embodiment of the present invention

With the structure, for introducing the molten metal into the ladle 3, no signal is transmitted from the controller 60, so that the electromagnetic valve 19 has the second change-over position 19Y as shown in FIG. 2 by the biasing force of the spring 19*c*. Thus, internal space of the valve body 8 is communicated with the atmosphere through the opening port 19*b*. Accordingly, the molten metal 2 in the holding furnace 1 can be introduced into the ladle 3.

For transferring the molten metal in the ladle 3, atmosphere shut-off signal S2' is transmitted from the controller 60 to the solenoid 19*a* through the line 60*c*. Therefore, the electromagnetic valve 19 is changed-over to the first change-over position 19X against the biasing force of the spring 19*c*. Accordingly, the internal space of the valve body 8 is shut-off from the atmosphere, to thereby block the molten metal retaining space 3*d* against the atmosphere. As a result, the molten metal can be retained in the ladle 3. In this case, since the first and second change-over valves 21', 31 have first change-over positions 21X', 31X, compressed fluid in the compressed fluid source 50 is not entered into the electromagnetic valve 19. Subsequent operation in terms of the vertical moving means 13 and the transfer unit 17, and atmosphere introduction into the ladle by means of the electromagnetic valve 19, change-over operations of the first and second change-over valves 21', 31 in response to the first and second operation command signals S3, S4 are the same as those of the first embodiment. Therefore, further description is negligible.

Incidentally, in the foregoing embodiments, a pressure regulator valve can be provided instead of the first flow rate control valve 22 having the check valve for applying compressed fluid having low pressure onto the surface of the molten metal in the ladle 3. Further, a pressure regulator valve can be used instead of the second flow rate control valve 32 having the check valve for applying pressurized fluid having high pressure into the ladle. However, if the pressure regulator valve is used in the first embodiment, the pressure regulator valve must be disposed at a position adjacent the first change-over valve 21 and upstream side thereof with respect to the compressed fluid source 50, otherwise highly pressurized fluid may be flowed into the first branch pipe 40*a*. Further, in the second embodiment, the valve body 8 may be dispensed with. That is, only the electromagnetic valve 19 is used as the opening/closing means which is directly connected to the tubular member 11. This modification also provides effect the same as that of the depicted second embodiment.

As described above, according to the automatic molten metal supplying device of this invention, since the predetermined amount (small volume) or low pressure fluid is applied to the molten metal in the ladle at the time of casting, the molten metal in the ladle can be efficiently discharged through the intake/discharge port by its own weight and the fluid pressure. Therefore, casting period can be reduced, and predetermined amount of casting can be achieved. Because of the reduction in casting period, temperature decrease of the molten metal in the ladle can be minimized at a low level, and shot cycle can also be reduced. Because of the reduction in shot cycle, the generation of oxide film at the surface of the molten metal in the ladle can be restrained, to thereby enhance quality of the casted product. Further, according to the present invention, since large volume or high pressure fluid is applied into the ladle after the completion of the casting, the volume and pressure of the pressurized fluid being greater than those at the casting phase, residual molten metal which may be suspended in the form of icicle from the intake/discharge port can be removed. Thus, molten metal introduction into the ladle in the subsequent operation can be ensured. Further, resultant device can be simplified, and a low cost device can be provided.

While the invention has been described in detail and with reference to specific embodiments thereof, it would be apparent to those skilled in the art that various changes and modifications may be made therein without departing from the spirit and scope of the invention.

What is claimed is:

1. An automatic molten metal supplying device for automatically supplying a small volume of a molten metal in a holding furnace to an intended casing port, the small volume being in a range of from 5 to several hundred grams, the device comprising:

a ladle providing a molten metal accumulation space and having a lower portion formed with a molten metal intake/discharge port through which the molten metal is introduced into the accumulation space and the molten metal is poured into the casting port, the ladle having an upper portion;

opening/closing means connected to the upper portion of the ladle for selectively communicating the accumulation space with an atmosphere;

molten metal pressurizing mechanism connected to the opening/closing means for supplying pressurized fluid having a first pressure level higher than an atmosphere pressure into the accumulation space through the opening/closing means during casing for promoting discharge of the molten metal from the ladle; and residual molten metal removing mechanism connected to the opening/closing means for supplying pressurized fluid having a second pressure level higher than the first pressure level into the accumulation space through the opening/closing means after completion of the casting for removing residual molten metal suspended from the intake/discharge port in icicle form.

2. The automatic molten metal supplying device as claimed in claim 1, further comprising a compressed fluid source connected to the opening/closing means.

3. The automatic molten metal supplying device as claimed in claim 2, wherein the molten metal pressurizing mechanism comprises;

a first change-over valve connected between the opening/closing means and the compressed fluid source, the first change-over valve movable between a first change-over position for preventing a compressed fluid in the compressed fluid source from being flowed into the opening/closing means and a second change-over position for flowing the compressed fluid to the opening closing means; and a first flow rate regulating means connected between the opening/closing means and the first change over valve for restricting a flow amount of the compressed fluid to provide the first pressure level.

4. The automatic molten metal supplying device as claimed in claim 3, wherein the residual molten metal pressurizing mechanism comprises:

a second change-over valve connected between the opening/closing means and the compressed fluid source, the second change-over valve movable between a first change-over position for preventing a compressed fluid from being flowed into the opening/closing means and a second change-over position for flowing the compressed fluid to the opening/closing means; and a second flow rate regulating means connected between the opening/closing means and the second change over valve for regulating a flow amount of the compressed fluid to provide the second pressure level.

5. The automatic molten metal supplying device as claimed in claim 4, further comprises a pipe means having one end connected to the opening/closing means and another end branched into first and second pipes, the molten metal pressuring mechanism being connected to the first branch pipe, and the residual molten metal removing mechanism being connected to the second branch pipe.

6. The automatic molten metal supplying device as claimed in claim 5, further comprises a control means connected to the opening/closing means, the first change-over valve and the second change-over valve for selectively providing change-over positions of these valves.

7. The automatic molten metal supplying device as claimed in claim 6, wherein the opening/closing means comprises:

an electromagnetic valve connected to the compressed fluid source and the control means, the electromagnetic valve being movable between first and second change-over positions;

a valve body formed with a bore in communication with the molten metal accumulation space, the valve body being also formed with a through hole to which the first and second change-over valves are connected;

an opening/closing valve slidably disposed in the valve body for selectively closing the bore;

a pneumatic cylinder disposed on the valve body, the pneumatic cylinder defining therein a cylinder chamber;

a piston slidably disposed in the pneumatic cylinder and connected to the opening/closing valve, the piston dividing the cylinder chamber into first and second cylinder chambers, the electromagnetic valve being selectively connected to one of the first and second cylinder chambers for supplying a compressed fluid to one of the first and second cylinder chambers in accordance with the change-over position of the electromagnetic valve.

8. The automatic molten metal supplying device as claimed in claim 7, wherein the first change-over valve is provided with an output port for communicating the molten metal accumulation space with an atmosphere through the through hole, the pipe and the first branch pipe when the first change-over valve is moved to the second change-over position.

9. The automatic molten metal supplying device as claimed in claim 6, wherein the opening/closing means comprises:

an electromagnetic valve connected to the control means and to the first and second change-over valves, the electromagnetic valve being movable between first and second change-over positions;

a valve body formed with a bore in communication with the molten metal accumulation space, the valve body being also formed with a through hole to which the electromagnetic valve is connected, the first and second change-over valves being connected to the change-over valve, and a compressed fluid source being selectively connected to the valve body through the through hole in accordance with the change-over position of the electromagnetic valve.

10. The automatic molten metal supplying device as claimed in claim 9, wherein the electromagnetic valve is provided with an output port for communicating the valve body with an atmosphere when the electromagnetic valve is moved to the second change-over position, the valve body being disconnected from the atmosphere when the electromagnetic valve is moved to the first change-over position.

11. The automatic molten metal supplying device as claimed in claim 6, wherein the opening closing means comprises an electromagnetic valve directly connected to the molten metal accumulation space.

12. A method for automatically supplying a small amount of metal to an intended casting port the small amount being in the range of from 5 to several hundred grams, the method including the steps of introducing the molten metal into a ladle at a holding furnace by communicating an interior of the ladle with an atmosphere, transferring the ladle which retains the molten metal therein to a casting port while disconnecting the interior from the atmosphere, the improvement comprising the steps of:

communicating the interior of the ladle with the atmosphere for discharging the molten metal into the casing port by making use of atmosphere pressure and own weight of the molten metal;

supplying from a compressed fluid source a pressurized fluid having a first pressure level higher than an atmospheric pressure, toward the molten metal retained in the ladle for promoting the discharge of the molten metal from the ladle; and supplying from the compressed fluid source the pressurized fluid having a second pressure level higher than the first pressure level, into the ladle for removing a residual molten metal which may be suspended from the ladle.

13. The device of claim 1, wherein said pressurizing mechanism supplies a first volume of pressurized fluid and said removing mechanism supplies a second volume of pressurized fluid which is larger than said first volume.

14. The method of claim 12, wherein said supplying steps supply a first volume of pressurized fluid having said first pressure and a second volume of pressurized fluid having said second pressure, said second volume being greater than said first volume.

* * * * *